United States Patent [19]

Wikelski et al.

[11] Patent Number: 4,654,154

[45] Date of Patent: Mar. 31, 1987

[54] METHOD OF REDUCING COMPRESSOR GAS LEAKAGE

[75] Inventors: Karl W. Wikelski; Michael S. Conrad, both of Odessa, Tex.

[73] Assignee: El Paso Polyolefins Company, Paramus, N.J.

[21] Appl. No.: 426,409

[22] Filed: Sep. 29, 1982

[51] Int. Cl.[4] ..... C40M 179/00
[52] U.S. Cl. ..... 252/11
[58] Field of Search ..... 252/11

[56] References Cited

PUBLICATIONS

Smalheer, C. V. et al., "Lubricant Additives", 1967, p. 7, Antioxidants.

*Primary Examiner*—William R. Dixon, Jr.
*Assistant Examiner*—Cynthia A. Prezlock
*Attorney, Agent, or Firm*—Fred S. Valles; Margareta LeMaire

[57] ABSTRACT

Gas leakage from a high pressure compressor used in providing olefin monomer feed to a high pressure polymerization reactor is minimized by the addition of an antioxidant to the cylinder lubrication fluid to provide an antioxidant concentration of from about 3 wt % to about 10 wt %.

6 Claims, No Drawings

METHOD OF REDUCING COMPRESSOR GAS LEAKAGE

BACKGROUND OF THE INVENTION

The present invention relates to a method of reducing cylinder gas leakage from compressors used in high pressure olefin polymerization processes and to increase the time intervals between replacements of worn cylinder assemblies.

In commercial high pressure polymerization processes, e.g. for the production of low density polyethylene, ethylene-vinyl acetate copolymers, etc., the monomer feed is conventionally brought to the desired reactor inlet pressure by means of multi stage reciprocating compressors. Because of the high pressures involved, i.e., at least about 1000 atmospheres and typcally from about 1500 to about 3000 atmospheres, accurate fitting of the packing around the periphery of the plunger rod is essential to provide adequate sealing and minimize gas leakage from the compressor cylinder along the plunger to the atmosphere. It is also necessary to provide correct lubrication to minimize frictional wear, and to this end a lubricating liquid is normally fed to the periphery of the plunger at one or more locations. In normal operations it is usually possible to maintain the gas leakage at about 2–3 percent of the total feed to the compressor or less.

However, for reasons heretofore unknown, there will occur periods, sometimes extending over several months, during which time extra high pressures are generated within the compressor gas cylinders especially in the low pressure end of the assemblies. The probability of such occurrences increase with increasing operating pressure. The detrimental results range from costly recovery and recompression of the gases leaking from the cylinder to severe cylinder component damage and release of volatile and combustible gas to the atmosphere.

THE INVENTION

It has now been found that by adding from about 3 to about 10 wt % of an antioxidant to the lubricating fluid provided to a compressor cylinder, the gas leakage from the compressor can be maintained at a desired low rate during the aforementioned upset periods compared to side-by-side operations of compressors lubricated with lubricants containing at most very small quantities of antioxidants. It has been discovered that the problem of increased gas leakage is due to an oxidation reaction occurring in the narrow annular passageway between the plunger and the cylinder packing. This unwanted oxidation appears to be caused by impurities introduced with the feed. It is believed that the impurities act as a catalyst and cause an uncontrolled reaction of the monomer gas normally leaking from the high pressure compression zone towards the low pressure end of the cylinder assembly, thereby causing an increase in pressure and the gas leakage rate. In severe cases, damage to the packing elements are experienced, necessitating a premature shutdown for replacement of worn cylinder assemblies.

The specifics of the internal design of the high pressure reciprocating compressor is not important to the success of the invention, and any operable high pressure compressors can be used, e.g., of the types disclosed in U.S. Pat. Nos. 3,128,941, 3,490,774, 3,670,630, 3,756,611, 4,229,011, hereby incorporated into this application by reference.

In general, these compressors have at least two compression stages with provision for interstage cooling of the gas. Each stage usually contains two or more lubricated cylinder assemblies. Antioxidant/lubricant is fed to the cylinder(s) of at least one of these stages, preferably at least to the cylinder or cylinders of the first stage.

The lubricant used for the lubrication of the plunger can be any commercially available compound known to perform well under the conditions prevailing in a high pressure compressor for providing olefin feed to a polymerication zone. Examples of such lubricants include highly refined paraffinic oils, sometimes containing viscosity modifiers such as polyisobutylene.

As received by the supplier, the lubricants may have been premixed with an antioxidant additive such as hindered phenols. If antioxidants are present the concentration thereof in the lubricant is usually between 0.5 to 1.0 percent. For the purpose of this invention the antioxidant concentration of the lubricant includes any minor portion already added by the lubricant manufacturer. The preferred range of antioxidant concentration in the lubricant is between about 3.5 and about 8 wt %.

Antioxidants useful in the invention include phenolic antioxidants, aromatic amines an any other antioxidant, which is completely soluble in the lubricant at the concentrations and conditions used. Such compounds are well known and commercially available. A list of the most common commercially available antioxidants is found in the yearly copies of Modern Plastics Encyclopedia, McGraw Hill, Inc. Examples of antioxidants suited for the invention are the alkylated phenols such as 2,6-di-t-butyl-para-cresol (BHT); alkylidene polyphenols such as the mono- and polyesters of alcohols and alkane polyols, such as octadecyl-3(3,5-di-t-butyl-4-hydroxyphenyl)propionate, the pentaerythritol tetraester of 3(3,5-di-t-butyl, 4- hydroxyphenyl)propionic acid; derivatives or homologs of hydroquinone, e.g. monobenzyl ether of hydroquinone or 2,5-di-t-butylhydroquinone; bisphenols such as 2,2'-methylene bis(4-methyl-6-t-butylphenol) and 4,4'-methylenebis(2,6-di-t-butylphenol); bisthiophenols; primary polyamines such as p,p'-diaminodiphenylmethane; diarylamines and modified diarylamines, e.g., N-phenyl-$\alpha$-naphthylamine, N-phenyl-$\beta$-naphthylamine, p-isopropoxydiphenylamine, mono- and dioctyldiphenylamine; bisdiarylamines and modified bisdiarylamines such as N,N'-diphenyl-p-phenylenediamine, N,N'-di-$\beta$-naphthyl-p-phenylenediamine, N-cyclohexyl-N'-phenyl-p-phenylenediamine; dihydroquinolines, e.g., 1,2-dihydro-2,2,4-trimethyl-6-phenylquinoline; aldehydeamine condensation products, e.g., aldol-$\alpha$-naphtylamine condensation products, butyraldehyde-aniline condensation products; alkylarylamines, e.g., N,N'-diphenylethylenediamine; aldehydeimines, e.g., N,N'-disalicylalethylenediamine and mixtures of two or more of the antioxidants listed above.

Since the leakage gas is usually recovered from a conduit at the low pressure end of the cylinder assembly, recompressed and then returned to the reaction loop, it is preferable that the particular antioxidant composition used in the invention is one which is approved by the Food and Drug Administration when the product from the polymerization process is to be used in contact with foods. Lists of approved antioxidants are found in Title 21, Code of Federal Regulations, part 178.2010.

The amount of antioxidant introduced with the recompressed leakage gas is very small, since the leakage gas represents on an average only about 2–3% of the total monomer gas being compressed and the weight ratio of lubricant feed monomer feed is also very small, typically in the order of from about 1:1000 to about 1:10,000. Thus, the antioxidant actually introduced into the polymerization reaction zone is so small that any inhibiting effect of the antioxidant upon the polymerization reaction is negligible.

There is no particular problem associated with the addition of the antioxidant to the lubricating oil. Generally, the additive lubricant mixture is stirred for a sufficient length of time to ensure a homogeneous solution of constant concentration. It may be advantageous in some cases to employ elevated temperatures, e.g. up to about 200° F. to hasten and/or increase the dissolution of the antioxidant into the lubricant.

The invention is used with advantage in the polymerization of one or more alpha-olefins using pressures of about 15,000 to about 50,000 psi. Alternately, other comonomers may be employed together with the alpha-olefin such as vinylacetate. Ethylene is a preferred monomer feed component in the process.

For a better understanding of the invention reference is made to the following example.

EXAMPLE

Three Ingersoll-Rand reciprocating hyper compressors each having two first stage cylinders and four second stage cylinders were used as secondary compressors in compressing fresh feed ethylene for introduction into an ethylene polymerization reactor. The first stage cylinders were of the piston ring assembly type while the second stage cylinders were of the packed plunger assembly type. Both of these assembly types are well known in the art and require no further description. The first stage suction pressure was maintained in the range of 3500–4000 psi, that of the second stage between about 12,000 to about 16,000 psi and the ethylene discharge pressure from the second stage varied between 40,000 and 45,000 psi. The ethylene introduced at the first stage suction end amounted to approximately 25,000 lbs/hour. Lubricant, a highly refined paraffin oil containing about 15% polyisobutylene (Witco 600 PHLA-3 TM) was supplied to each of the first stage cylinders at a rate of about 0.05 gal/hr and to each of the second stage cylinders at a rate of about 0.24 gal/hr. The lubricating oil being supplied to one of the three compressors had been premixed with BHT antioxidant at concentrations indicated below, while the lubricants being supplied to the remaining cylinders contained no antioxidant.

The gas leakages from each cylinder assembly were monitored over extended periods of times and the average hourly leakage rates per 1000 hours of cylinder life were calculated from these data. A direct comparison of the results from the operation of the comparison showed that a 2 wt % antioxidant concentration in the lubricant did not cause any significant reduction in cylinder gas leakage as compared to that obtained from a same stage cylinder lubricated with a BHT-free oil. However, at a 4% by weight incorporation the antioxidant had a remarkable effect in decreasing the leakage, especially in the first stage cylinders. The pertinent data are shown in Table 1.

TABLE 1

| Average leakage-lbs. hr/ 1000 hrs. cyl. life | COMPRESSOR STAGE | |
|---|---|---|
| | FIRST | SECOND |
| @ 0% BHT in lubricant | 16.16 | 15.05 |
| @ 4% BHT in lubricant | 7.07 | 13.76 |

It is to be understood that many modifications and alterations may be made to the method without departing from the scope of this invention, which is defined by the specification and appended claims.

What is claimed is:

1. In a high pressure polymerization process in which monomer feed prior to introduction to the polymerization zone is compressed to reaction pressure in a compressor having at least one compression stage, and at least one lubricated compressor cylinder assembly, the method of reducing compressor gas leakage caused by impurities introduced by the monomer feed comprising providing at least one compressor cylinder assembly with a lubricant containing from about 3 to about 10 wt % of an antioxidant.

2. The method of claim 1 wherein the antioxidant concentration is maintained between about 3.5 and about 8 wt %.

3. The method of claim 1, wherein the antioxidant is selected from the group consisting of phenolic antioxidants, aromatic amines and mixtures thereof.

4. The method of claim 1, wherein the antioxidant is 2,6-di-t-butyl-p-cresol.

5. The method of claim 1, wherein the antioxidant-containing lubricant is provided to a first stage cylinder assembly.

6. The method of claim 1, wherein the antioxidant-containing lubricant is provided to a second stage cylinder assembly.

* * * * *